US010066867B2

(12) United States Patent
Tamboli

(10) Patent No.: US 10,066,867 B2
(45) Date of Patent: Sep. 4, 2018

(54) REFRIGERATOR QUICK RELEASE MECHANISM AND METHOD OF REMOVABLY COUPLING A DOOR TO A DRAWER SLIDE

(71) Applicant: Whirlpool Corporation, Benton Harbor, MI (US)

(72) Inventor: Manjur Tamboli, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/392,218

(22) Filed: Dec. 28, 2016

(65) Prior Publication Data

US 2018/0180348 A1 Jun. 28, 2018

(51) Int. Cl.

| | |
|---|---|
| ***A47B 96/04*** | (2006.01) |
| ***F25D 23/02*** | (2006.01) |
| ***F25D 11/02*** | (2006.01) |
| ***F25D 25/02*** | (2006.01) |
| ***A47B 88/407*** | (2017.01) |
| ***A47B 88/43*** | (2017.01) |
| ***F25D 23/04*** | (2006.01) |

(52) U.S. Cl.

CPC ..... *F25D 23/028* (2013.01); *A47B 88/407* (2017.01); *A47B 88/43* (2017.01); *F25D 11/02* (2013.01); *F25D 23/021* (2013.01); *F25D 23/04* (2013.01); *F25D 25/025* (2013.01)

(58) Field of Classification Search

CPC ..... F25D 23/028; F25D 23/021; F25D 23/04; F25D 11/02; A47B 88/43; A47B 88/407

See application file for complete search history.

(56) References Cited

U.S. PATENT DOCUMENTS

| | | | | |
|---|---|---|---|---|
| 2,090,648 | A * | 8/1937 | Straubel | A47B 88/944 220/558 |
| 6,981,752 | B2 * | 1/2006 | Harn | A47B 88/956 312/348.4 |
| 7,467,834 | B2 * | 12/2008 | Kim | F25D 23/021 312/402 |
| 8,215,730 | B2 | 7/2012 | Brown et al. | |
| 8,544,970 | B2 * | 10/2013 | Jung | F25D 23/021 312/348.1 |
| 9,033,436 | B2 * | 5/2015 | Holzapfel | A47B 88/0055 312/348.4 |
| 9,101,211 | B2 * | 8/2015 | Cabal Velarde | A47B 88/0055 |
| 9,433,292 | B2 * | 9/2016 | Dubina | F25D 25/025 |
| 9,752,817 | B2 * | 9/2017 | Richards | F25D 23/028 |

(Continued)

FOREIGN PATENT DOCUMENTS

| | | |
|---|---|---|
| JP | 09-021585 | 9/1997 |

*Primary Examiner* — Hanh Van Tran

(74) *Attorney, Agent, or Firm* — Diederiks & Whitelaw, PLC

(57) ABSTRACT

A refrigerator includes a refrigerated compartment and a drawer having a drawer slide, a door and a quick release mechanism. The drawer slide allows the drawer to slide into and out of the refrigerated compartment, and the door selectively seals the refrigerated compartment. The quick release mechanism removably couples the door to the drawer slide. The quick release mechanism includes a latch and a keeper. The latch is pivotally coupled to one of the door and the drawer slide, and the keeper has a slot for receiving the latch.

20 Claims, 4 Drawing Sheets

(56) References Cited

U.S. PATENT DOCUMENTS

| | | | | |
|---|---|---|---|---|
| 2002/0153816 | A1* | 10/2002 | Banicevic | F25D 23/04 312/404 |
| 2011/0080081 | A1 | 4/2011 | Klausing et al. | |
| 2013/0264928 | A1* | 10/2013 | Hong | F25D 25/025 312/404 |
| 2013/0270987 | A1 | 10/2013 | Kelly | |
| 2015/0260447 | A1* | 9/2015 | Kim | F25D 27/005 312/405 |
| 2016/0018157 | A1* | 1/2016 | Dubina | F25D 23/021 312/404 |
| 2016/0178274 | A1 | 6/2016 | Shin | |
| 2016/0305705 | A1 | 10/2016 | Dubina et al. | |

* cited by examiner

REFRIGERATOR QUICK RELEASE MECHANISM AND METHOD OF REMOVABLY COUPLING A DOOR TO A DRAWER SLIDE

BACKGROUND OF THE INVENTION

The present invention pertains to refrigerators and, more particularly, to quick release mechanisms for refrigerator doors.

Currently, many refrigerators require the removal of a door during installation. After installation, the door is reattached. This typically involves unscrewing and then screwing several fasteners. In practice, this can be difficult to accomplish, which can lead to damage to the refrigerator or the area where the refrigerator is installed. In addition, a difficult installation procedure makes improper installation more likely, with improper installation potentially causing sealing or other door misalignment issues.

In view of the above, it would be desirable to provide a quick and easy way to remove and reattach a refrigerator door, particularly during installation of a refrigerator.

SUMMARY OF THE INVENTION

The present invention is directed to a refrigerator comprising a refrigerated compartment and an associated drawer including a drawer slide, a door and a quick release mechanism. The drawer slide is configured to allow the drawer to slide into and out of the refrigerated compartment, and the door is configured to selectively seal the refrigerated compartment. The quick release mechanism is configured to removably couple the door to the drawer slide. The quick release mechanism includes a latch and a keeper. The latch is pivotally coupled to one of the door and the drawer slide, and the keeper has a slot configured to receive the latch. To couple the door to the drawer slide, the latch is inserted into the slot.

In one embodiment, the keeper is U-shaped, and the slot is defined between the legs of the "U". Preferably, the keeper is formed integrally with the drawer slide.

In one embodiment, the latch has a notch configured to receive a portion of the keeper. The quick release mechanism further includes a spring configured to bias the latch in a downward, latching direction. To uncouple the door from the drawer slide, the latch is lifted in an upward direction such that the portion of the keeper exits the notch. Preferably, the quick release mechanism further includes a bracket coupled to the door, the latch being pivotally coupled to the bracket.

In one embodiment, the drawer slide includes a vertical portion having a first end and a second end. The first end is coupled to the door by the quick release mechanism, and the second end is coupled to the door by a threaded fastener.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention, which may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention. In addition, as used in connection with the present invention, terms such as "horizontal", "vertical", "upward", "downward" and the like do not necessarily require that the relevant structure be perfectly horizontal or vertical. Instead, these terms are intended to encompass structure that is sufficiently vertical, for example, so as to function essentially the same as structure that is perfectly vertical.

Figure 1:
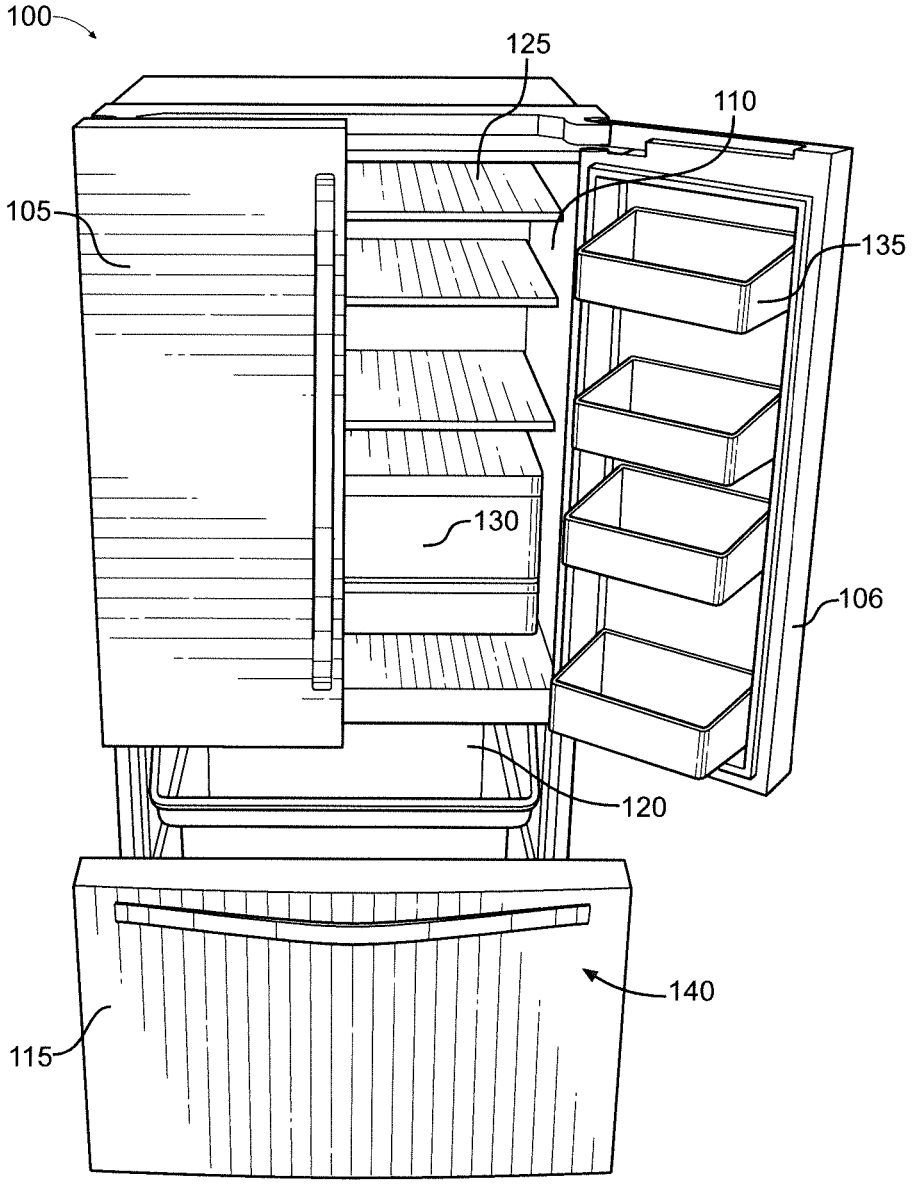
FIG. 1 is a front perspective view of a refrigerator constructed in accordance with the present invention.

With initial reference to FIG. 1, a front perspective view of a refrigerator 100 constructed in accordance with the present invention is provided. Refrigerator 100 is shown in a French door bottom mount configuration, although the present invention can be used with other refrigerator configurations. Refrigerator 100 includes two fresh food doors 105 and 106, which selectively seal a fresh food compartment 110, and a freezer door 115, which selectively seals a freezer compartment 120. Refrigerator 100 also includes a plurality of shelves (one of which is labeled 125), a plurality of drawers (one of which is labeled 130) and a plurality of door bins (one of which is labeled 135). Freezer door 115 is part of a freezer drawer 140, which can slide into and out of freezer compartment 120. Although not visible, refrigerator 100 includes a refrigeration system that establishes above and below freezing temperatures in compartments 110 and 120, respectively. In other words, the refrigeration system cools the refrigerated compartments of refrigerator 100.

Figure 2A:
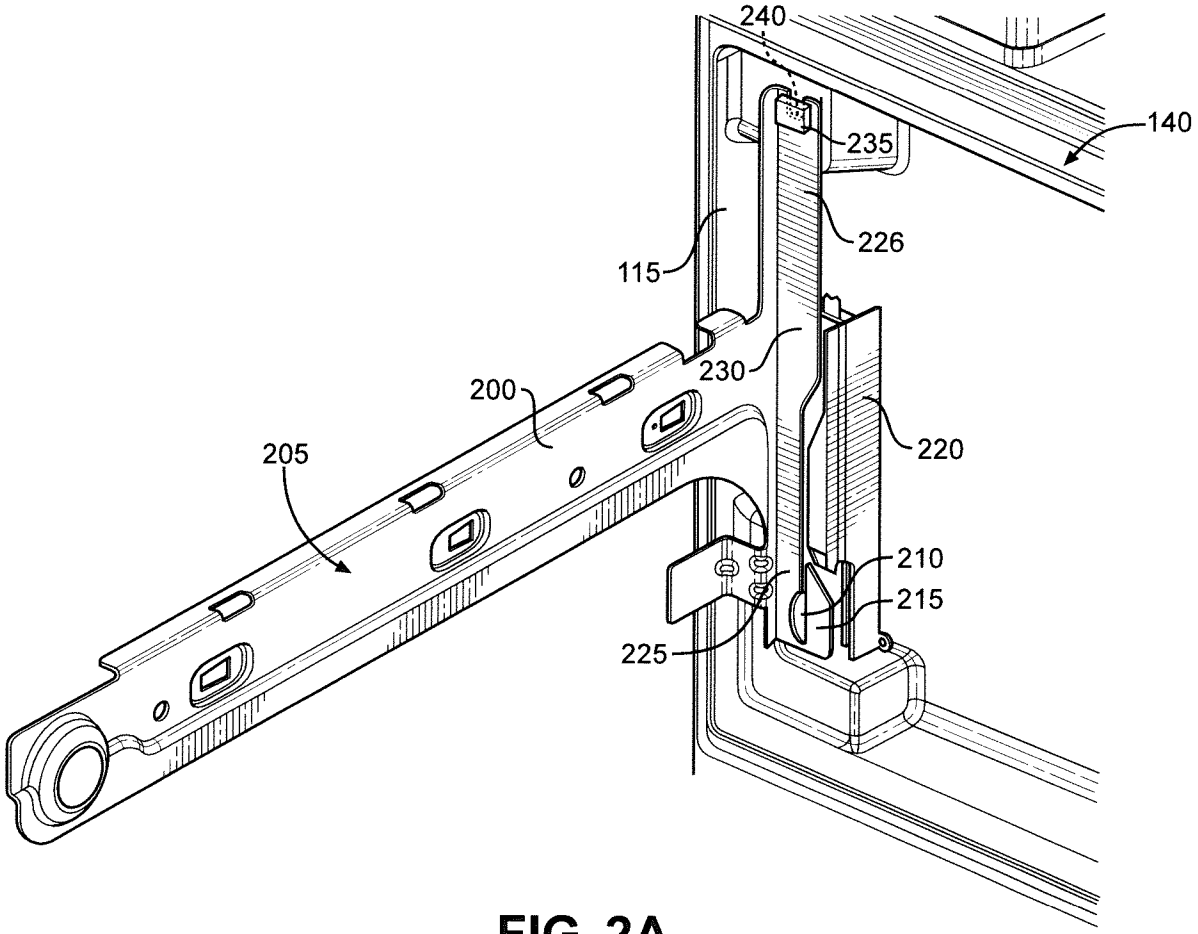
FIG. 2A is a rear perspective view of a freezer door of the refrigerator.

With reference now to FIG. 2A, a rear perspective view of freezer door 115 is provided. A door member 200 of a drawer slide 205 is coupled to freezer door 115. Although the other portions of drawer slide 205 are not shown, it should be understood that drawer slide 205 allows freezer drawer 140 to slide into and out of freezer compartment 120. In a typical prior art arrangement, the drawer slide 205 would be coupled to the freezer door 115 using a plurality of fasteners (e.g., screws) so that removal of the door would require the use of one or more tool. However, the present invention improves upon this arrangement. Specifically, door member 200 is coupled to freezer drawer 115 using a quick release mechanism including a latch 210 and a keeper 215. Latch 210 is secured to freezer door 115 using a bracket 220. Keeper 215 is formed in a lower end 225 of a vertical portion 230 of door member 200. Vertical portion 230 also includes an upper end 226 formed with a three-sided cut-out 240 which opens upwardly. A retainer 235 having an enlarged head (not separately labeled) relative to cut-out 240 is factory mounted to drawer 140. Retainer 235 can be made of metal or plastic and has a shaft portion (not shown) positioned to be received in cut-out 240, with upper end 226 being received between freezer door 115 and the enlarged head of retainer 235.

Figure 3:
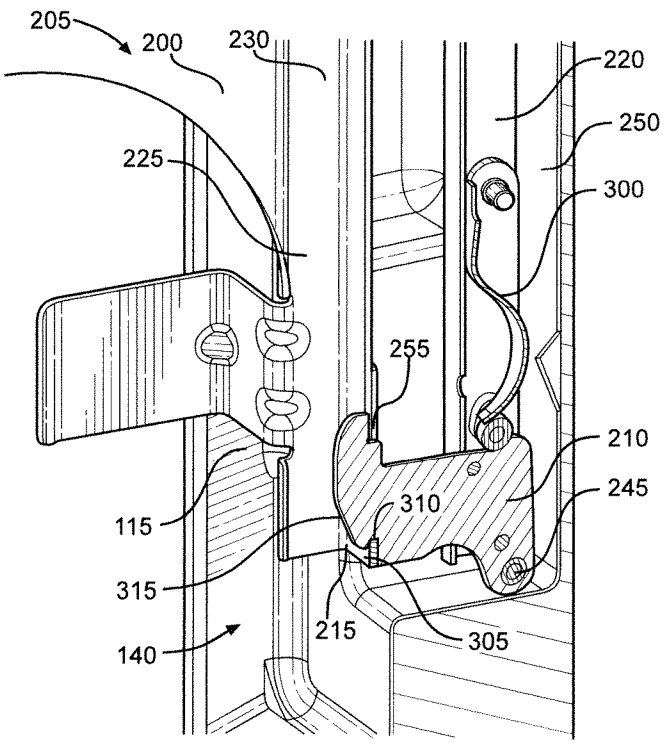
FIG. 3 is a cross section of the freezer door.
Figure 2B:
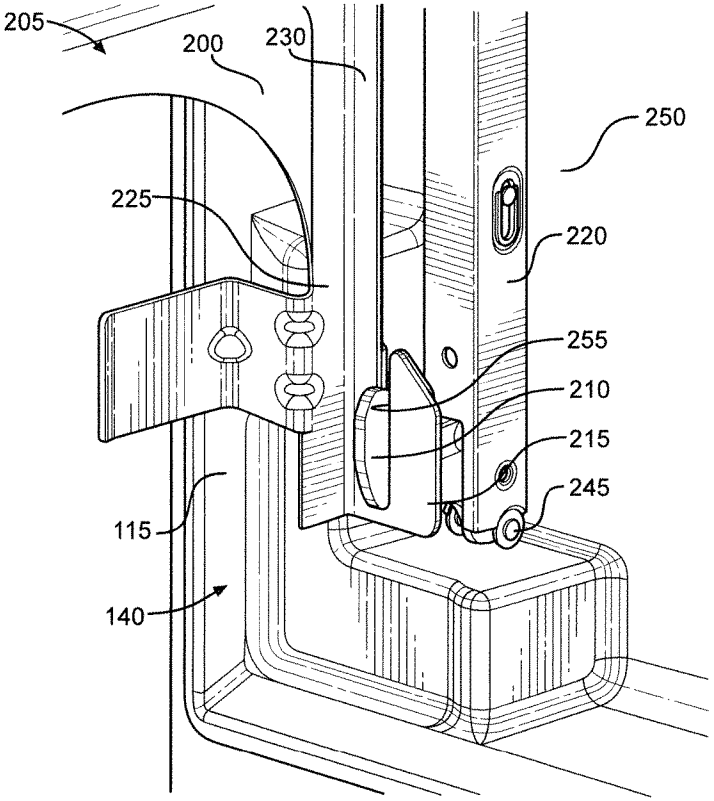
FIG. 2B is an enlarged view of a portion of FIG. 2A.

The details of the quick release mechanism are more easily seen in FIG. 2B, which is an enlarged view of a portion of FIG. 2A, along with FIG. 3. Latch 210 is pivotably coupled to bracket 220 by a pin 245, with bracket 220 being coupled to a rear face 250 of freezer door 115. Keeper 215 is U-shaped such that a slot 255 is defined between the legs of the "U". When freezer door 115 is coupled to door member 200, latch 210 is received in slot 255. Preferably, keeper 215 is formed integrally with the rest of door member 200. However, keeper 215 can be formed separately from and then coupled to door member 200.

As can be best seen in FIG. 3, which is a cross section of the quick release mechanism, a leaf spring 300 biases latch 210 in a downward direction (i.e., counterclockwise), wherein a bottom portion 305 of keeper 215 is received in a notch 310 of latch 210. To detach freezer door 115 from door member 200, latch 210 is pivoted upward (i.e., clockwise) such that bottom portion 305 exits notch 310. Latch 210 is then pushed away from keeper 215 to shift latch 210 from within slot 255. Thereafter, freezer door 115 can simply be lifted to remove retainer 235 from within cut-out 240. During attachment of freezer door 115 to door member 200, freezer door 115 is first hung on door member 200 by retainer 235 (note again that an identical arrangement is provided on each side of freezer door 140) and then latch 210 is inserted into slot 255. Specifically, latch 210 is moved toward keeper 215 until a front face 315 of latch 210 comes into contact with bottom portion 305. Further movement of latch 210 toward keeper 215 forces latch 210 to pivot upward. Next, bottom portion 305 enters notch 310 as latch 210 pivots back downward, thereby securing freezer door 215 to door member 200 without the need for any tools.

Figure 4A:
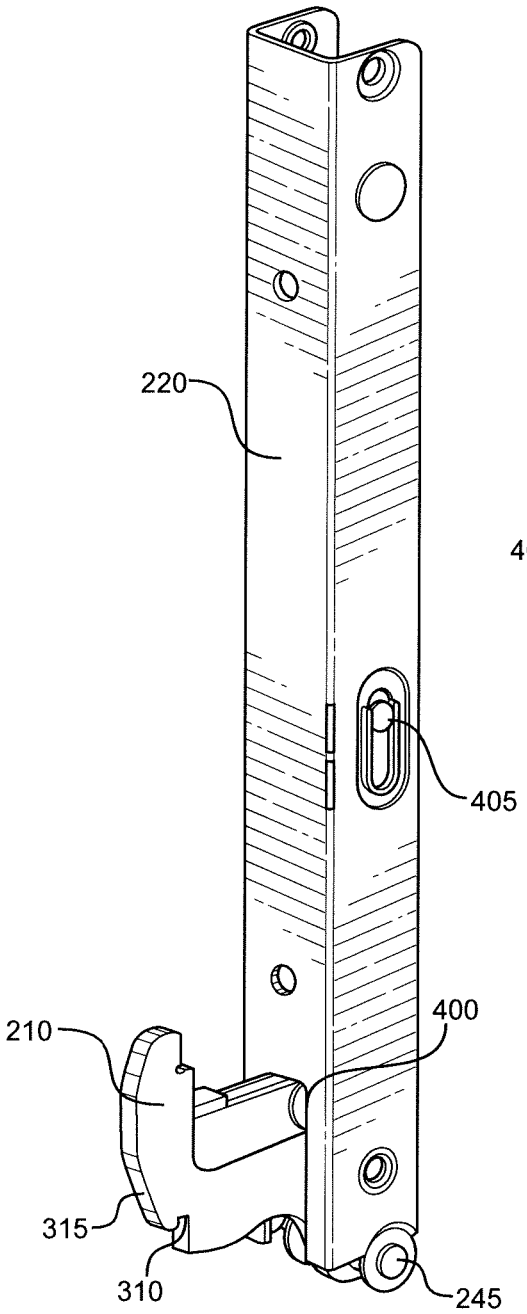
FIG. 4A is a front perspective view of a bracket of the refrigerator.
Figure 4B:
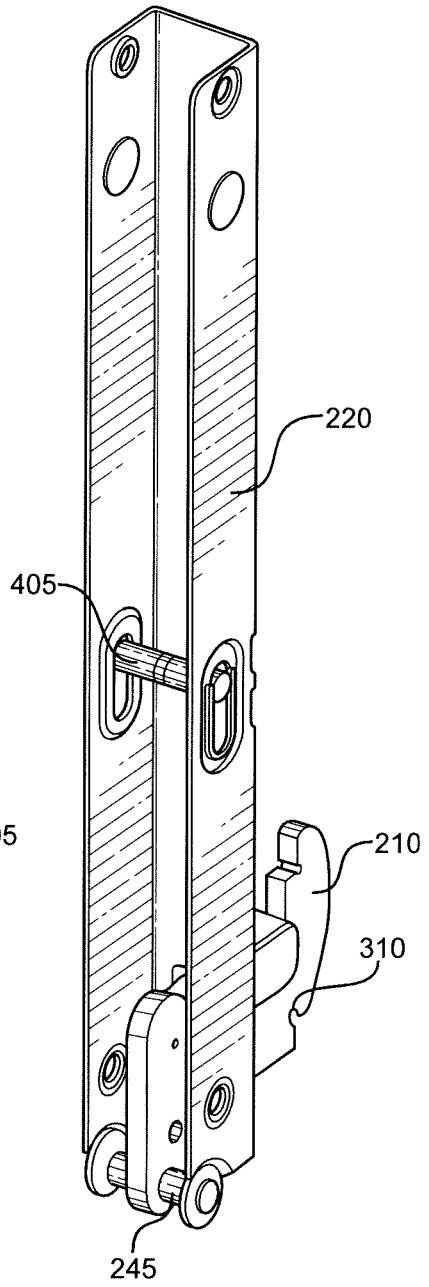
FIG. 4B is a rear perspective view of the bracket.

FIGS. 4A and 4B show bracket 220 separate from freezer door 115. Bracket 220 is U-shaped and includes a slot 400 through which latch 210 extends. Bracket 220 also includes pins 245 and 405. As discussed above, pin 245 couples latch 210 to bracket 220 and serves as the pivot point for latch 210. Pin 405 couples leaf spring 300 to bracket 220, although leaf spring 300 is not shown in FIGS. 4A and 4B.

While only one side or end of freezer door 115 is shown, it should be recognized that corresponding structure is preferably provided on the other end. In addition, the quick release mechanism of the present invention can be used with other refrigerator drawers, as well as non-refrigerator drawers. Furthermore, although latch 210 is shown as being coupled to freezer door 115 and keeper 215 is shown as being coupled to door member 200, the positions of latch 210 and keeper 215 can be reversed.

Based on the above, it should be readily apparent that the present invention provides a quick and easy way to remove and reattach a refrigerator door, particularly during installation of a refrigerator. Although described with reference to preferred embodiments, it should be readily understood that various changes or modifications could be made to the invention without departing from the spirit thereof. In general, the invention is only intended to be limited by the scope of the following claims.

The invention claimed is:

1. A refrigerator comprising:

a refrigerated compartment;

a drawer including:

a drawer slide configured to allow the drawer to slide into and out of the refrigerated compartment;

a door configured to selectively seal the refrigerated compartment;

a quick release mechanism configured to removably couple the door to the drawer slide, the quick release mechanism including:

a latch pivotally coupled to one of the door and the drawer slide; and a keeper having a slot configured to receive the latch, wherein the drawer slide includes a portion having a first end and a second end, the first end is coupled to the door by the quick release mechanism, and the second end is coupled to the door by a retainer.

2. The refrigerator of claim 1, wherein the keeper is U-shaped as defined by a pair of legs spaced by the slot.

3. The refrigerator of claim 2, wherein the keeper is formed integrally with the drawer slide.

4. The refrigerator of claim 1, wherein the latch has a notch configured to receive a portion of the keeper.

5. The refrigerator of claim 4, wherein the quick release mechanism further includes a spring configured to bias the latch downward into engagement with the keeper.

6. The refrigerator of claim 4, wherein:

the quick release mechanism further includes a bracket coupled to the door; and the latch is pivotally coupled to the bracket.

7. The refrigerator of claim 1, wherein the retainer is positioned in a cut-out formed in the second end of the portion.

8. A quick release mechanism for removably coupling a door to a drawer slide, the drawer slide being configured to allow a drawer to slide into and out of a compartment, and the door being configured to selectively seal the compartment, the quick release mechanism comprising:

a latch pivotally coupled to one of the door and the drawer slide; and a keeper having a slot configured to receive the latch, wherein the drawer slide includes a vertical portion having a first end and a second end, the first end is coupled to the door by the quick release mechanism, and the second end is coupled to the door by a retainer.

9. The quick release mechanism of claim 8, wherein the keeper is U-shaped as defined by a pair of legs spaced by the slot.

10. The quick release mechanism of claim 9, wherein the keeper is formed integrally with the drawer slide.

11. The quick release mechanism of claim 8, wherein the latch has a notch configured to receive a portion of the keeper.

12. The quick release mechanism of claim 11, further comprising a spring configured to bias the latch downward into engagement with the keeper.

13. The quick release mechanism of claim 11, further comprising a bracket coupled to the door, wherein the latch is pivotally coupled to the bracket.

14. The quick release mechanism of claim 8, wherein the retainer is positioned in a cut-out formed in the second end of the vertical portion.

15. A method of removably coupling a refrigerator door to a drawer slide, the drawer slide being configured to allow a drawer to slide into and out of a refrigerated compartment, and the door being configured to selectively seal the compartment, the method comprising:

inserting a latch into a slot of a keeper, the latch being pivotally coupled to one of the door and the drawer slide, wherein the drawer slide includes a portion having a first end and a second end, and the first end is coupled to the door by inserting the latch into the slot, the method further comprising coupling the second end to the door with a retainer.

16. The method of claim 15, wherein inserting the latch into the slot includes causing a portion of the keeper to enter a notch of the latch.

17. The method of claim 16, further comprising biasing the latch in a downward direction into engagement with the keeper.

18. The method of claim 17, wherein inserting the latch into the slot includes forcing the latch to pivot in an upward direction.

19. The method of claim 17, further comprising uncoupling the door from the drawer slide by lifting the latch in an upward direction such that the portion of the keeper exits the notch.

20. The method of claim 15, wherein the retainer is attached to the door, and coupling the second end to the door includes positioning the retainer, into a cut-out formed in the second end of the portion.

* * * * *